US010500848B2

(12) United States Patent
Michels et al.

(10) Patent No.: US 10,500,848 B2
(45) Date of Patent: Dec. 10, 2019

(54) DIVIDING PRINTER SPITS INTO BURSTS

(71) Applicant: Hewlett-Packard Development Company, L.P., Houston, TX (US)

(72) Inventors: Lisa Michels, Vancouver, WA (US); Randal J Morrison, Vancouver, WA (US); Kyle Mannari, Vancouver, WA (US); Cristopher Royce Jansson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/780,093

(22) PCT Filed: Mar. 28, 2016

(86) PCT No.: PCT/US2016/024481
§ 371 (c)(1),
(2) Date: May 30, 2018

(87) PCT Pub. No.: WO2017/171709
PCT Pub. Date: Oct. 5, 2017

(65) Prior Publication Data

US 2018/0345662 A1 Dec. 6, 2018

(51) Int. Cl.
*B41J 2/045* (2006.01)
*B41J 2/235* (2006.01)
(Continued)

(52) U.S. Cl.
CPC ..... *B41J 2/04573* (2013.01); *B41J 2/0458* (2013.01); *B41J 2/04543* (2013.01);
(Continued)

(58) Field of Classification Search
CPC .... B41J 2/0573; B41J 2/04586; B41J 2/1707; B41J 2/16526; B41J 2/0458;
(Continued)

(56) References Cited

U.S. PATENT DOCUMENTS 5,710,581 A 1/1998 Barton et al.
5,774,141 A 6/1998 Cooper et al.
(Continued)

FOREIGN PATENT DOCUMENTS

CN 105034601 A 11/2015
JP H04-062065 2/1992
(Continued)

OTHER PUBLICATIONS

BV Korthofah, Kortho GraphicJet X-Series Manual. Edition: H550AE Rev:001, Jan. 2, 2016, 178 pages.

*Primary Examiner* — Sharon A. Polk
(74) *Attorney, Agent, or Firm* — Dicke Billig & Czaja PLLC

(57) ABSTRACT

A printer includes a printhead assembly, a service station assembly, and a controller. The printhead assembly includes nozzles to eject fluid drops. The nozzles are divided into a least two groups with each group assigned a burst drop count, a post-burst delay, and a burst order. The service station assembly is to receive fluid ejected from the nozzles during spits. The controller is to control a spit of the printhead assembly by ejecting fluid from the nozzles of each group based on the burst drop count, the post-burst delay, and the burst order of each group until a target drop count for the spit is reached.

18 Claims, 3 Drawing Sheets

(51) Int. Cl.
*B41J 2/165* (2006.01)
*B41J 2/17* (2006.01)

(52) U.S. Cl.
CPC ..... *B41J 2/04586* (2013.01); *B41J 2/16526* (2013.01); *B41J 2/1707* (2013.01); *B41J 2/235* (2013.01); *B41J 2002/1657* (2013.01); *B41J 2002/16573* (2013.01)

(58) Field of Classification Search
CPC ..... B41J 2/04543; B41J 2/235; B41J 2002/1657; B41J 2002/16573
See application file for complete search history.

(56) References Cited

U.S. PATENT DOCUMENTS

| | | | | |
|---|---|---|---|---|
| 6,293,646 | B1 * | 9/2001 | Beachnau Hood | B41J 2/16526 347/23 |
| 7,066,564 | B2 | 6/2006 | Holstun | |
| 7,984,959 | B2 | 7/2011 | DeVore et al. | |
| 2005/0212851 | A1 | 9/2005 | Akase et al. | |
| 2012/0212525 | A1 | 8/2012 | Jaumot et al. | |
| 2012/0223994 | A1 | 9/2012 | Yuda et al. | |
| 2015/0029259 | A1 | 1/2015 | Humet et al. | |
| 2015/0198715 | A1 | 7/2015 | Garay et al. | |
| 2015/0258779 | A1 | 9/2015 | Ito et al. | |

FOREIGN PATENT DOCUMENTS

| | | | |
|---|---|---|---|
| JP | 2005-059480 | A | 3/2005 |
| JP | 2005-262551 | A | 9/2005 |
| JP | 200923259 | A | 2/2009 |
| JP | 2015174315 | A | 10/2015 |
| JP | 20162650 | A | 1/2016 |
| WO | WO-09808687 | | 3/1998 |
| WO | WO-2015167452 | | 11/2015 |
| WO | WO-2016018277 | | 2/2016 |

* cited by examiner

DIVIDING PRINTER SPITS INTO BURSTS

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Printhead servicing spits may eject ink from all the nozzles of a printhead continuously until a target drop count for the spit is reached. Aerosol generated by printhead servicing may cause customer dissatisfaction due to contamination of the printer and the printer output, and lower printer reliability due to failure of sensors and/or encoders exposed to high amounts of aerosol. Missing, weak, and/or misdirected drops of ink from nozzles may also cause customer dissatisfaction due to degraded print quality.

Accordingly, printers as described herein include burst spitting (also known as entrained spitting). Burst spitting divides servicing spits into multiple bursts to reduce aerosol, control the movement of aerosol, and improve nozzle health. The number of ink drops in each burst, the time between bursts, and the order of colors and/or groups of nozzles during spitting are optimized to reduce aerosol and improve nozzle health. Burst spitting reduces and/or limits aerosol generated by printhead servicing during normal printing and outside of normal printing, controls the movements of aerosol from printhead servicing during normal printing and outside of normal printing, and improves print quality by reducing the missing, weak, and/or misdirected drops of ink from nozzles.

Figure 1A:
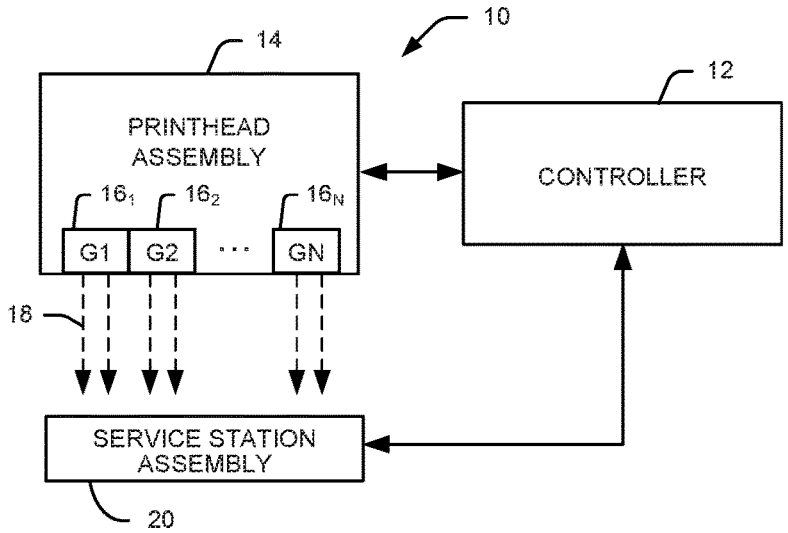
FIG. 1A is a block diagram illustrating one example of an inkjet printing system.

FIG. 1A is a block diagram illustrating one example of an inkjet printing system 10. Inkjet printing system 10 includes a controller 12, a printhead assembly 14 including nozzles to eject fluid drops as indicated at 18, and a service station assembly 20. The nozzles are divided into a least two groups $\mathbf{16}_1$ to $\mathbf{16}_N$ with each group assigned a burst drop count, a post-burst delay, and a burst order. Service station assembly 20 is to receive fluid ejected from the nozzles during spits. Controller 12 is to control a spit of printhead assembly 14 by ejecting fluid from the nozzles of each group $\mathbf{16}_1$ to $\mathbf{16}_N$ based on the burst drop count, the post-burst delay, and the burst order of each group until a target drop count for the spit is reached.

Figure 1B:
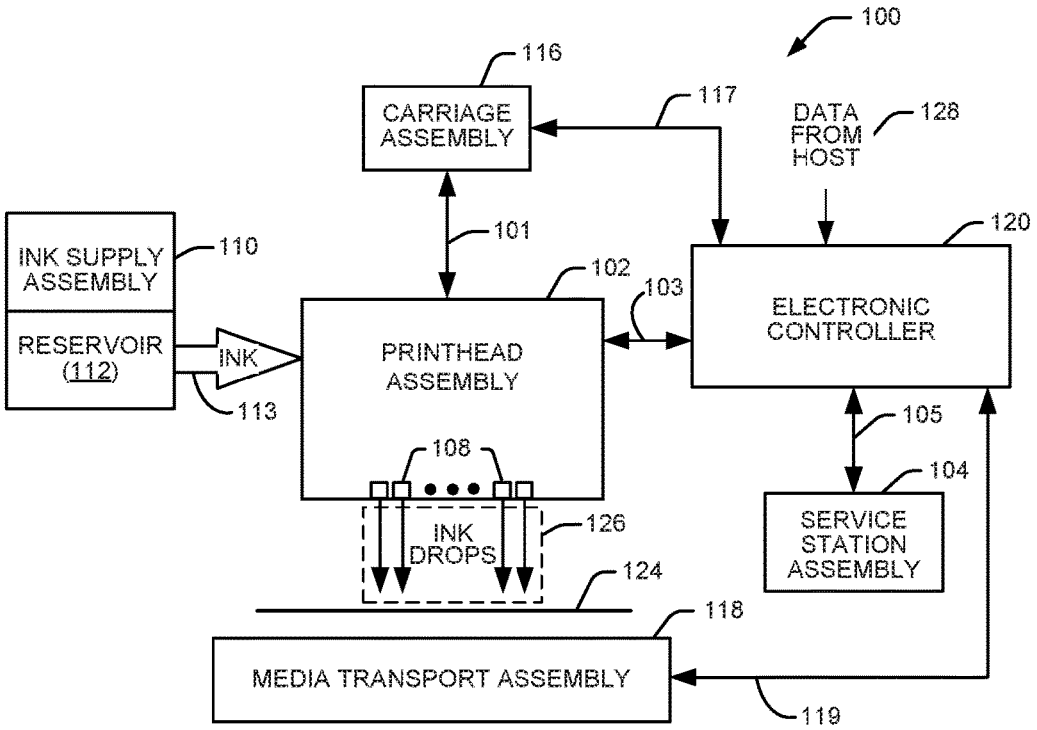
FIG. 1B is a block diagram illustrating another example of an inkjet printing system.

FIG. 1B is a block diagram illustrating another example of an inkjet printing system 100. Inkjet printing system 100 includes a fluid ejection assembly, such as printhead assembly 102, and a fluid supply assembly, such as ink supply assembly 110. In the illustrated example, inkjet printing system 100 also includes a service station assembly 104, a carriage assembly 116, a print media transport assembly 118, and an electronic controller 120. While the following description provides examples of systems and assemblies for fluid handling with regard to ink, the disclosed systems and assemblies are also applicable to the handling of fluids other than ink.

Printhead assembly 102 includes at least one printhead or fluid ejection device which ejects drops of ink or fluid through a plurality of orifices or nozzles 108. In one example, the drops are directed toward a medium, such as print media 124, so as to print onto print media 124. Print media 124 includes any type of suitable sheet material, such as paper, card stock, transparencies, Mylar, fabric, and the like. In one example, nozzles 108 are arranged in at least one column or array such that properly sequenced ejection of ink from nozzles 108 causes characters, symbols, and/or other graphics or images to be printed upon print media 124 as printhead assembly 102 and print media 124 are moved relative to each other.

Ink supply assembly 110 supplies ink to printhead assembly 102 and includes a reservoir 112 for storing ink. As such, in one example, ink flows from reservoir 112 to printhead assembly 102. In one example, printhead assembly 102 and ink supply assembly 110 are housed together in an inkjet or fluid-jet print cartridge or pen. In another example, ink supply assembly 110 is separate from printhead assembly 102 and supplies ink to printhead assembly 102 through an interface connection 113, such as a supply tube and/or valve.

Carriage assembly 116 positions printhead assembly 102 relative to print media transport assembly 118 and print media transport assembly 118 positions print media 124 relative to printhead assembly 102. Thus, a print zone 126 is defined adjacent to nozzles 108 in an area between printhead assembly 102 and print media 124. In one example, printhead assembly 102 is a scanning type printhead assembly such that carriage assembly 116 moves printhead assembly 102 relative to print media transport assembly 118.

Service station assembly 104 provides for spitting, wiping, capping, and/or priming of printhead assembly 102 to maintain the functionality of printhead assembly 102 and, more specifically, nozzles 108. For example, service station assembly 104 may include a rubber blade or wiper which is periodically passed over printhead assembly 102 to wipe and clean nozzles 108 of excess ink. In addition, service station assembly 104 may include a cap that covers printhead assembly 102 to protect nozzles 108 from drying out during periods of non-use. In addition, service station assembly 104 may include a spittoon into which printhead assembly 102 ejects ink during spits to insure that reservoir 112 maintains an appropriate level of pressure and fluidity, and to insure that nozzles 108 do not clog or weep. Functions of service station assembly 104 may include relative motion between service station assembly 104 and printhead assembly 102.

Electronic controller 120 communicates with printhead assembly 102 through a communication path 103, service station assembly 104 through a communication path 105, carriage assembly 116 through a communication path 117, and print media transport assembly 118 through a communication path 119. In one example, when printhead assembly 102 is mounted in carriage assembly 116, electronic controller 120 and printhead assembly 102 may communicate via carriage assembly 116 through a communication path 101. Electronic controller 120 may also communicate with ink supply assembly 110 such that, in one implementation, a new (or used) ink supply may be detected.

Electronic controller 120 receives data 128 from a host system, such as a computer, and may include memory for temporarily storing data 128. Data 128 may be sent to inkjet printing system 100 along an electronic, infrared, optical or other information transfer path. Data 128 represent, for example, a document and/or file to be printed. As such, data 128 form a print job for inkjet printing system 100 and includes at least one print job command and/or command parameter.

In one example, electronic controller 120 provides control of printhead assembly 102 including timing control for ejection of ink drops from nozzles 108. As such, electronic controller 120 defines a pattern of ejected ink drops which form characters, symbols, and/or other graphics or images on print media 124. Timing control and, therefore, the pattern of ejected ink drops, is determined by the print job commands and/or command parameters. In one example, logic and drive circuitry forming a portion of electronic controller 120 is located on printhead assembly 102. In another example, logic and drive circuitry forming a portion of electronic controller 120 is located off printhead assembly 102.

Electronic controller 120 also controls printhead assembly 102 during spits for maintaining nozzles 108. Instead of ejecting ink from all the nozzles of a printhead assembly continuously until a target drop count is reached for a spit, electronic controller 120 divides spits into bursts and controls the order in which colors and/or groups of nozzles execute bursts and the delays between the bursts. The bursts followed by the delays for each group repeat in order until the target drop count for the spit is reached. In this way, aerosol generated during spits is reduced, the movement of aerosol during spits is controlled, and nozzle health is improved.

Figure 2:
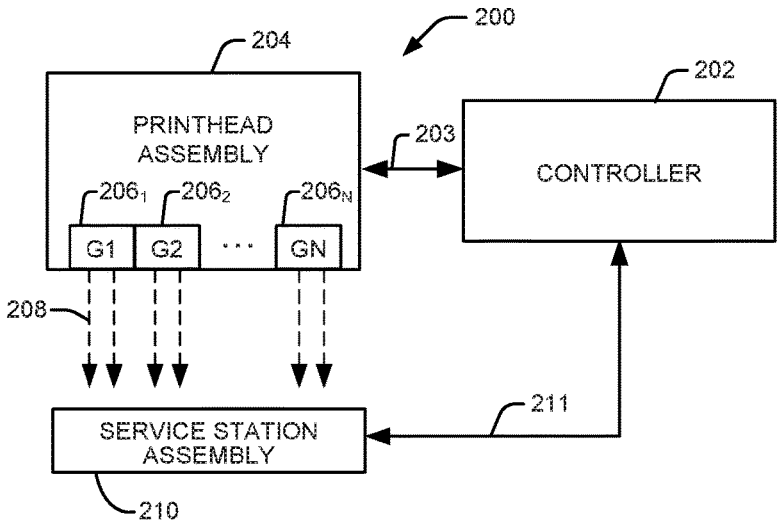
FIG. 2 is a block diagram illustrating one example of an inkjet printing system during a spit.

FIG. 2 is a block diagram illustrating one example of an inkjet printing system 200 during a spit. Inkjet printing system 200 includes a controller 202, a printhead assembly 204, and a service station assembly 210. Controller 202 is communicatively coupled to printhead assembly 204 through a communication path 203 and service station assembly 210 through a communication path 211. Controller 202 controls printhead assembly 204 and service station assembly 210, including controlling printhead assembly 204 during spits.

Printhead assembly 204 includes a plurality of nozzles arranged in at least one column or array. In this example, for spitting, the nozzles are grouped into a plurality of groups G1 $\mathbf{206}_1$ to GN $\mathbf{206}_N$, where "N" is any suitable number of groups. Each group may include any suitable number of nozzles. Each group may include the same number of nozzles or a different number of nozzles from the other groups. Groups may include nozzles that are all adjacent to each other or nozzles that are separated from each other by nozzles of at least one other group. The nozzles may be grouped by the color of the ink ejected from each nozzle. In one example, each group may be based on the physical location of the nozzles, such as each group including at least one column of nozzles of printhead assembly 204. In another example, each group may be based on how the nozzles are energized during printing, such as each group including at least one fire line or data group. In other examples, the nozzles of printhead assembly 204 may be grouped for spits based on other criteria that results in reduced aerosol generation, controlled movement of aerosol, and/or improved nozzle health.

During a spit, controller 202 positions printhead assembly 204 over service station assembly 210 such that service station assembly 210 may receive the ink ejected from each group of nozzles G1 $\mathbf{206}_1$ to GN $\mathbf{206}_N$ as indicated at 208. Controller 202 controls each group of nozzles G1 $\mathbf{206}_1$ to GN $\mathbf{206}_N$ during a spit to eject ink based on a burst drop count, a post-burst delay, and a burst order of each group until a target drop count for the spit is reached. In one example, all the nozzles of a group are fired simultaneously during a burst until the burst drop count for the group is reached. In another example, every other nozzle (i.e., half of the nozzles) of a group are alternately fired during a burst until the burst drop count for the group is reached. In other examples, the nozzles within a group are fired in another suitable sequence until the burst drop count for the group is reached.

Figure 3:
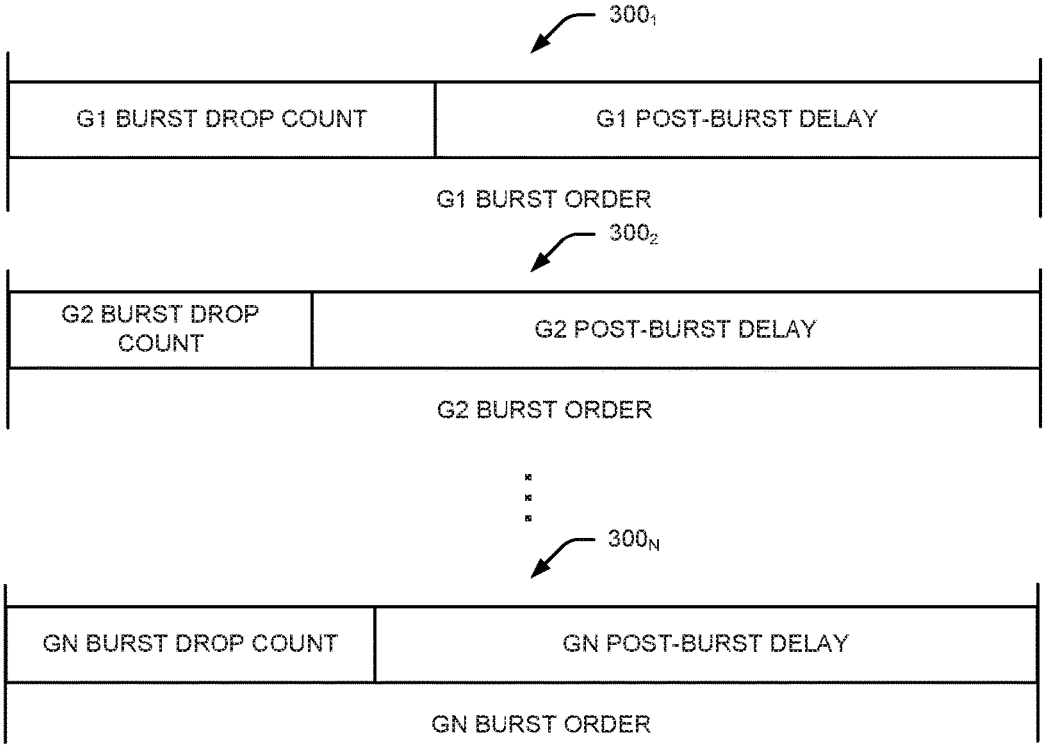
FIG. 3 illustrates one example of assigned values for burst drop count, post-burst delay, and burst order for each group of nozzles of FIG. 2.

FIG. 3 illustrates one example of assigned values for burst drop count, post-burst delay, and burst order for each group of nozzles previously described and illustrated with reference to FIG. 2. The assigned values $\mathbf{300}_1$ to $\mathbf{300}_N$ correspond to each group of nozzles G1 $\mathbf{206}_1$ to GN $\mathbf{206}_N$, respectively. The assigned values $\mathbf{300}_1$ for the first group (G1) include a first burst drop count, a first post-burst delay, and a first burst order. The assigned values $\mathbf{300}_2$ for the second group (G2) include a second burst drop count, a second post-burst delay, and a second burst order. Likewise, the assigned values $\mathbf{300}_N$ for the $N^{th}$ group (GN) include an $N^{th}$ burst drop count, an $N^{th}$ post-burst delay, and an $N^{th}$ burst order.

Each burst drop count indicates the number of drops of ink to eject during a burst for the corresponding group of nozzles. The burst drop count may be the same for each group or may be different for each group. The burst drop count for each group may be any suitable number of drops. For example, the burst drop count for each group may be between 10 and 1000 drops, such as 30 drops, 40 drops, or 1000 drops.

The post-burst delay indicates the time after a corresponding burst completes that should elapse prior to another burst starting. The post-burst delay for each group may be the same for each group or may be different for each group. The post-burst delay for each group may be any suitable delay. For example, the post-burst delay may be between 0.5 and 10 milliseconds, such as between 0.5 and 5 milliseconds or between 0.5 and 1.5 milliseconds.

The burst order for each group indicates the order in which each group executes a burst. More than one group may have the same burst order such that more than one group may execute a burst simultaneously with another group. When more than one group has the same burst order, the beginning of the bursts may be aligned. In this case, the next group or groups having the next burst order do not start their bursts until the post-burst delay for all the groups having the same previous burst order have elapsed.

The bursts of each group are repeated until the target drop count for the spit is reached. For example, to execute a spit having a target drop count of 30 drops where each group has a burst drop count of 30 drops, each group will execute one burst during the spit in the order specified by the burst order for each group. To execute a spit having a target drop count of 50 drops, for example, where each group has a burst drop count of 25 drops, each group will execute two bursts during the spit in the order specified by the burst order for each group. To execute a spit having a target drop count of 100 drops, for example, where a first group has a burst drop count of 25 drops and a second group has a burst drop count of 50 drops, the first group will execute four bursts and the second group will execute two bursts during the spit in the order specified by the burst order for each group. In this case, once the second group reaches the target drop count after two bursts, the second group is removed from the sequence and the first group and any other remaining groups continue to execute bursts in the order specified by the burst order for each group until each group has reached the target drop count.

Figure 4:
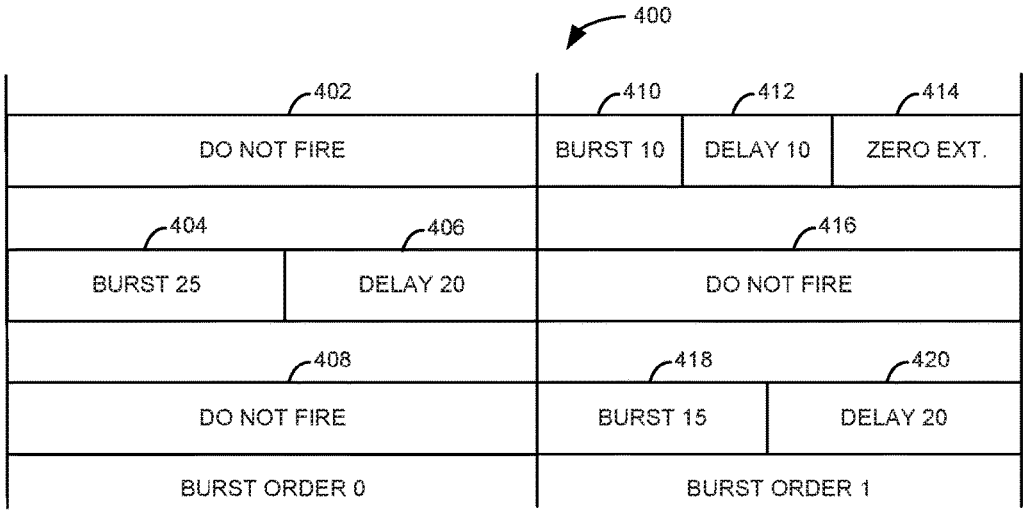
FIG. 4 illustrates one example of a spit profile for a printer.

FIG. 4 illustrates one example of a spit profile 400 for a printer. In this example, the nozzles of a printer are divided into four groups based on the colors K (black), C (cyan), M (magenta), and Y (yellow) for a KCMY 4-color printer. Spit profile 400 is merely an example to describe how a spit profile may be configured and may not be suitable for implementation within a printer. Spit profile 400 may be represented as follows:

{0, 10, 25, 15, // burst drop count 0, 10, 20, 20, // post-burst delay (represented in 0.1 ms increments)

−1, 1, 0, 1}; // burst order

// K C M Y grouping

Accordingly, as indicated by the above representation, the group of nozzles that eject K (black) ink are excluded from the spit as indicated by the burst order of −1, the burst drop count of 0, and the post-burst delay of 0. The group of nozzles that eject C (cyan) ink are assigned a burst drop count of 10 drops, a post-burst delay of 10 (i.e., 1 ms), and a burst order of 1. The group of nozzles that eject M (magenta) ink are assigned a burst drop count of 25 drops, a post-burst delay of 20 (i.e., 2 ms), and a burst order of 0. The group of nozzles that eject Y (yellow) ink have a burst drop count of 15 drops, a post-burst delay of 20 (i.e., 2 ms), and a burst order of 1.

A graphical representation of spit profile 400 is illustrated in FIG. 4. For spit profile 400, the nozzles of the cyan and yellow groups assigned to burst order 1 do not fire when burst order 0 is active as indicated at 402 and 408. With burst order 0 active, the nozzles of the magenta group assigned burst order 0 first eject ink for a burst drop count of 25 as indicated at 404 followed by a post-burst delay of 20 as indicated at 406. Following the post-burst delay of the nozzles of the magenta group assigned burst order 0, burst order 1 becomes active. With burst order 1 active, the nozzles of the cyan group assigned burst order 1 eject ink for a burst drop count of 10 as indicated at 410 followed by a post-burst delay of 10 as indicated at 412. In addition, the nozzles of the yellow group also assigned burst order 1 eject ink for a burst drop count of 15 as indicated at 418 followed by a post-burst delay of 20 as indicated at 420. The start of each burst of the cyan and yellow groups assigned to burst order 1 are aligned. The nozzles of the magenta group do not fire when burst order 1 is active as indicated at 416.

Since in this example the post-burst delay of the cyan group of nozzles completes prior to the post-burst delay of the yellow group of nozzles, the post-burst delay of the cyan group of nozzles is zero extended as indicated at 414 to extend the delay to the end of the post-burst delay of the yellow group of nozzles. Following the bursts and post-burst delays of the cyan and yellow groups of nozzles assigned to burst order 1, the process repeats with burst order 0 becoming active followed by burst order 1 becoming active until a target drop count for the spit is reached.

Figure 5:
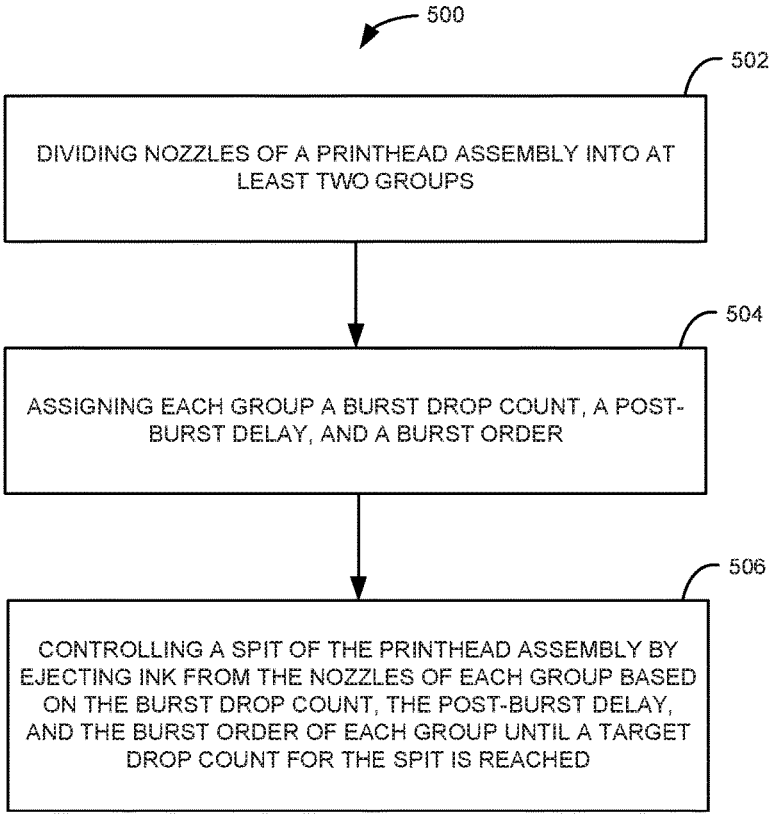
FIG. 5 is a flow diagram illustrating one example of a method for maintaining nozzles of a printhead assembly.

FIG. 5 is a flow diagram illustrating one example of a method 500 for maintaining nozzles of a printhead assembly. At 502, method 500 includes dividing nozzles of a printhead assembly into at least two groups. At 504, method 500 includes assigning each group a burst drop count, a post-burst delay, and a burst order. At 506, method 500 includes controlling a spit of the printhead assembly by ejecting ink from the nozzles of each group based on the burst drop count, the post-burst delay, and the burst order of each group until a target drop count for the spit is reached.

In one example, controlling the spit includes simultaneously ejecting ink from the nozzles of at least two groups based on the burst drop count, the post-burst delay, and the burst order of each group of the at least two groups. In another example, controlling the spit includes ejecting ink from each group one at a time based on the burst drop count, the post-burst delay, and the burst order of each group until the target drop count for the spit is reached. Method 500 may include controlling the spit during printing (e.g., a flying spit) or outside of printing (e.g., an into or out of cap spit or a pen recovery spit).

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printer comprising:

a printhead assembly comprising nozzles to eject fluid drops, the nozzles divided into a least two groups with each group assigned a burst drop count, a post-burst delay, and a burst order;

a service station assembly to receive fluid ejected from the nozzles during spits; and a controller to control a spit of the printhead assembly by ejecting fluid from the nozzles of each group based on the burst drop count, the post-burst delay, and the burst order of each group until a target drop count for the spit is reached.

2. The printer of claim 1, wherein a first group is assigned a first burst order and a second group is assigned a second burst order different from the first burst order.

3. The printer of claim 1, wherein a first group is assigned a first burst drop count and a second group is assigned a second burst drop count different from the first burst drop count.

4. The printer of claim 1, wherein a first group is assigned a first post-burst delay and a second group is assigned a second post-burst delay different from the first post-burst delay.

5. The printer of claim 1, wherein the nozzles are divided into the at least two groups based on a color of fluid to be ejected from the nozzles.

6. The printer of claim 1, wherein the controller is to control the spit of the printhead assembly to limit aerosol generated by the spit.

7. The printer of claim 1, wherein a first group is assigned a first burst drop count and a second group is assigned a second burst drop count, and wherein at least one of the first burst drop count and the second burst drop count is less than the target drop count.

8. A printer comprising:

a printhead assembly comprising a plurality of nozzles to eject fluid drops, the plurality of nozzles divided into at least a first group and a second group, the first group assigned a first burst drop count and a first post-burst delay and the second group assigned a second burst drop count and a second post-burst delay;

a service station assembly to receive fluid ejected from the plurality of nozzles during spits; and a controller to control the printhead assembly during a spit by repeatedly ejecting fluid from the nozzles of the first group for the first burst drop count followed by the first post-burst delay, followed by ejecting fluid from the nozzles of the second group for the second burst drop count followed by the second post-burst delay until a target drop count for the spit is reached.

9. The printer of claim 8, wherein the first burst drop count is within a range between 15 drops and 40 drops.

10. The printer of claim 8, wherein the first post-burst delay is within a range between 0.5 milliseconds and 5 milliseconds.

11. The printer of claim 8, wherein the first group of nozzles are to eject fluid of a first color and the second group of nozzles are to eject fluid of a second color different from the first color.

12. The printer of claim 8, wherein the plurality of nozzles are divided into the first group, the second group, and a third group, the third group assigned a third burst drop count and a third post-burst delay, and wherein the controller is to control the printhead assembly during the spit by repeatedly simultaneously ejecting fluid from the nozzles of the first and third groups for the first and third burst drop counts followed by the first and third post-burst delays, respectively, followed by ejecting fluid from the nozzles of the second group for the second burst drop count followed by the second post-burst delay until a target drop count for the spit is reached.

13. The printer of claim 8, wherein at least one of the first burst drop count and the second burst drop count is less than the target drop count.

14. A method for maintaining a printer, the method comprising:

dividing nozzles of a printhead assembly into at least two groups;

assigning each group a burst drop count, a post-burst delay, and a burst order; and controlling a spit of the printhead assembly by ejecting fluid from the nozzles of each group based on the burst drop count, the post-burst delay, and the burst order of each group until a target drop count for the spit is reached.

15. The method of claim 14, wherein controlling the spit comprises simultaneously ejecting fluid from the nozzles of at least two groups based on the burst drop count, the post-burst delay, and the burst order of each group of the at least two groups.

16. The method of claim 14, wherein controlling the spit comprises ejecting fluid from each group one at a time based on the burst drop count, the post-burst delay, and the burst order of each group until the target drop count for the spit is reached.

17. The method of claim 14, wherein controlling the spit comprises controlling the spit during printing.

18. The method of claim 14, wherein assigning each group a burst drop count comprises assigning at least one group a burst drop count less than the target drop count.

* * * * *